United States Patent [19]

Kasai

[11] Patent Number: 4,864,700

[45] Date of Patent: Sep. 12, 1989

[54] BUCKLE ASSEMBLY

[75] Inventor: Kazumi Kasai, Namerikawa, Japan

[73] Assignee: Yoshida Kogyo K.K., Tokyo, Japan

[21] Appl. No.: 287,136

[22] Filed: Dec. 21, 1988

[30] Foreign Application Priority Data

Dec. 28, 1987 [JP] Japan ..... 62-198970[U]

[51] Int. Cl.[4] ..... A44B 11/25

[52] U.S. Cl. ..... 24/573; 24/612; 24/614; 24/625; 24/671

[58] Field of Search ..... 24/573, 574, 323, 324, 24/312, 313, 606, 607, 625, 614, 615, 671, 672, 589, 612

[56] References Cited

U.S. PATENT DOCUMENTS

| | | | |
|---|---|---|---|
| 3,299,679 | 1/1967 | Anderson | 24/573 X |
| 3,542,426 | 11/1970 | Radke | 24/573 |
| 4,035,877 | 7/1977 | Brownson et al. | 24/323 |
| 4,559,679 | 12/1985 | Downey | 24/573 X |

FOREIGN PATENT DOCUMENTS

| | | | |
|---|---|---|---|
| 14704 | 8/1881 | Fed. Rep. of Germany | 24/589 |
| 6224721 | 2/1987 | Japan . | |

*Primary Examiner*—James R. Brittain

*Attorney, Agent, or Firm*—Hill, Van Santen, Steadman & Simpson

[57] ABSTRACT

A buckle assembly composed of three components, i.e. a socket, a main plug and an auxiliary plug for releasably connecting three straps or belts. The socket includes a cantilevered resilient locking arm interlockingly engageable with a resilient locking tongue of the main plug when the locking tongue is received in a guide chamber in the socket to thereby couple the socket and the main plug. The auxiliary plug is slidably mounted on the main plug and having two resilient, inwardly deformable locking legs snappingly engageable with respective retaining projections of the socket when the locking legs are received in the guide chamber. The auxiliary plug further includes a resilient releasing leg extending parallel to the locking legs and having a releasing cam projection engageable with the resilient locking arm to flex the latter outwardly away from the guide chamber for releasing the locking arm from interlocking engagement with the locking tongue, thereby uncoupling the main plug and the socket.

15 Claims, 5 Drawing Sheets

BUCKLE ASSEMBLY

BACKGROUND OF THE INVENTION

1. Field of the Invention

The present invention relates generally to buckles for releasably connecting belts on various articles such as helmets, life jackets and rucksacks, and more particularly to a buckle assembly composed of three structural components adapted to be coupled together to connect three strap end portions.

2. Description of the Prior Ar

A typical buckle assembly of the type described is disclosed in Japanese Utility Model Laid-Open Publication No. 62-24721. The disclosed buckle assembly is composed of three structural components, i.e. a retainer base attached to a first belt and having a transverse aperture or window, a socket attached to a second belt and having an upwardly projecting C-shaped locking lug, and a planar plug attached to a third belt. When the buckle assembly is to be assembled, the C-shaped locking lug of the socket is inserted into the aperture in the base, then the plug is forced into an opening in the C-shaped locking lug to couple the base and the socket, thereby connecting the first, second and third belts.

The known buckle assembly is however disadvantageous in that the base and the plug are structurally separated from one another and hence a tedious positional adjustment is necessary when the plug is inserted into the C-shaped locking lug, resulting in a time-consuming coupling operation of the buckle assembly. Another drawback is that the plug is flat and only force-fitted with the C-shaped locking lug. The thus constructed plug is likely to be detached from the locking lug when it is pulled away from the socket. As a result, a firm interlocking engagement between the base and the socket is difficult to obtain.

SUMMARY OF THE INVENTION

With the foregoing difficulties in view, it is an object of the present invention to provide a buckle assembly including a socket, a main plug and an auxiliary plug which can be assembled together quickly with utmost ease and can be retained firmly in assembled condition against accidental detachment.

According to the present invention, there is provided a buckle assembly for releasably connecting three belts comprising: a socket for being attached to a first belt and including a hollow socket body having a pair of opposed side walls an upper wall interconnecting respective upper edges of the side walls, and an intermediate wall extending between the side walls in parallel spaced relation to the upper wall so as to define, jointly with the side walls, and the upper wall, a guide chamber, the socket body further having a pair of retainer projections projecting from the side walls, respectively, into the guide chamber, the intermediate wall having a cantilevered resilient locking arm; a main plug for being attached to a second belt and including a base portion and a resilient locking tongue extending from an end of the base portion and receivable in the guide chamber in the socket body, the resilient locking tongue being interlockingly engageable with the resilient locking arm to couple the main plug and the socket; and an auxiliary plug for being attached to a third belt and slidably mounted on the main plug, the auxiliary plug including a head slidably retained on the base portion of the main plug, a pair of parallel spaced resilient locking legs extending from an end of the head and receivable in the guide chamber of the socket body, and a resilient releasing leg disposed between the resilient locking legs and extending from the end of the head in the same direction of the resilient locking legs, the resilient locking legs being snappingly engageable with the retaining projections, respectively, to couple the auxiliary plug and the socket, the resilient releasing leg having a releasing cam projection engageable with the resilient locking arm to flex the resilient locking arm against the resiliency of the same in a direction to disengage the resilient locking arm from the resilient locking tongue.

With this construction, the resilient locking tongue of the main plug and the resilient locking and releasing legs of the auxiliary plug are inserted into the guide chamber in the socket until the locking tongue is hooked with the resilient locking arm and the resilient locking legs are snapped with the respective retaining projections, thereby coupling the socket and the main and auxiliary plugs. When the auxiliary plug is moved to slide along guide grooves in the main plug in a direction away from the socket, the locking legs are released from the retaining projections and then the releasing cam projection is brought into abutment with the resilient locking arm to thereby flex the latter in a direction to release the resilient locking tongue from interlocking engagement with the resilient locking arm. With this releasing, the main plug and the auxiliary plug slidably mounted on the main plug can be detached from the socket.

Many other advantages and features of the present invention will become manifest to those versed in the art upon making reference to the detailed description and the accompanying sheets of drawings in which a preferred structural embodiment incorporating the principles of the present invention is shown by way of example.

DETAILED DESCRIPTION

A preferred embodiment of the present invention will be described hereinbelow in detail with reference to the accompanying drawings.

Figure 1:
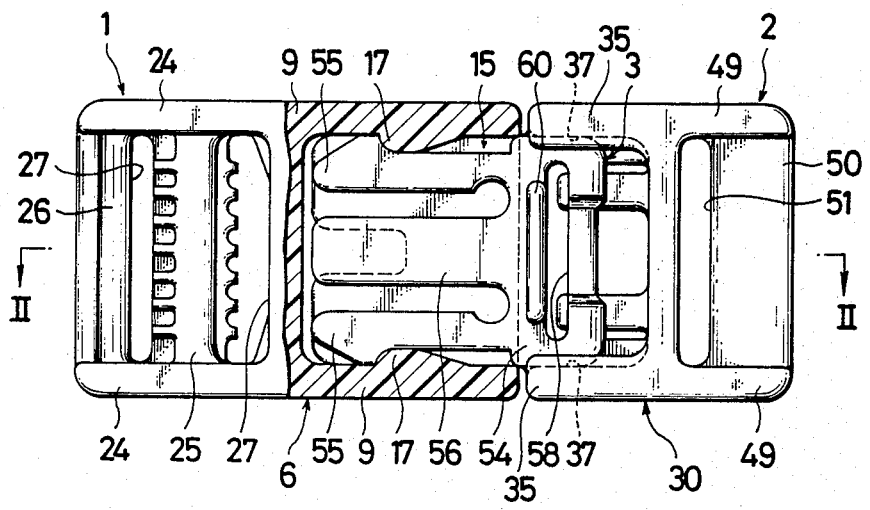
FIG. 1 is a plan view, with parts cut-away for clarity of a buckle assembly according to the present invention.
Figure 2:
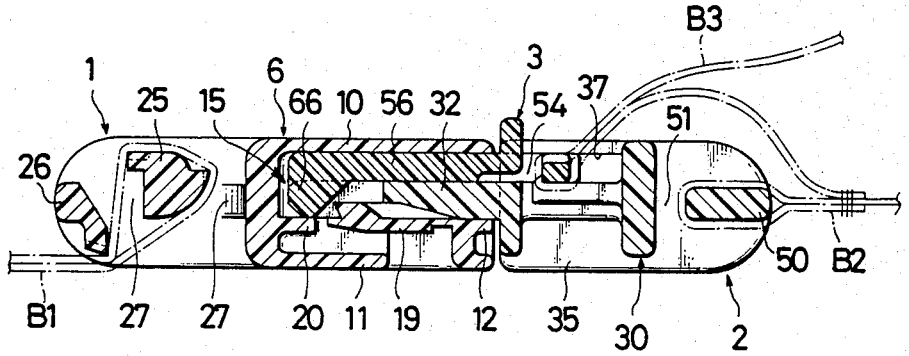
FIG. 2 is a cross-sectional view taken along line II—II of FIG. 1.

FIGS. 1 and 2 show a buckle assembly according to the present invention.

The buckle assembly is composed of three structural components, i.e. a socket 1, a main plug 2 releasably connected to the socket 1, and an auxiliary plug 3 slidably mounted on the main plug 2 and releasably connected to the socket 1. The socket 1, the main plug 2 and the auxiliary plug 3 are molded of a synthetic resin.

The socket 1, as shown in FIGS. 3 through 6, includes a generally rectangular box-like hollow body 6 and a belt retaining portion 7 integral with a closed end of the socket body 6. The socket body 6 is composed of a pair of opposed side walls 9, 9, upper and lower walls 10, 11 interconnected by the side walls 9, 9, a horizontal intermediate wall 12 disposed between the upper and lower walls 10, 11 and a rear end wall 13 closing a rear end of the hollow socket body 6, the front end 14 of the socket body 6 being open. The socket body has a guide chamber 15 defined between the upper wall 10 and the intermediate wall 12 for receiving a part of the main plug 2 and a part of the auxiliary plug 3 to couple the socket 1 and the main and auxiliary plugs 2, 3 together, as described later on.

The side walls 9, 9 have on their confronting inner surfaces a pair of retaining projections 17, 17 projecting into the guide chamber 15 for snapping engagement with a pair of resilient locking legs (described later), respectively, of the auxiliary plug 3. The retaining projections 17, 17 are disposed adjacent to the upper wall 10 and located centrally between the open end 14 and the closed end of the socket body 6. Each of the retaining projection 17, 17 has a rounded retaining surface **17*a* facing to the rear end wall 13 for interlocking engagement with one of a pair of locking lugs later described, of the respective locking legs, and a downwardly sloping guide wall 17*b* extending contiguously from the retaining surface 17*a* toward the open end 14 of the socket body 6** for guiding engagement with the locking lug.

Figure 5:
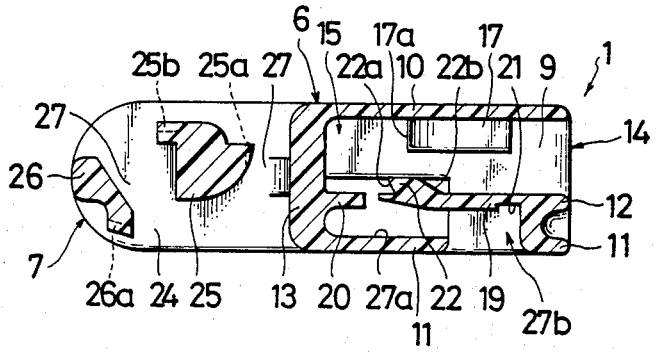
FIG. 5 is a cross-sectional view taken along line V—V of FIG. 3.

The intermediate wall 12 extends parallel to the upper and lower walls 10, 11 and is joined with the side walls 9, 9 at one end thereof adjacent to the open end 14 of the socket body 6. The intermediate wall 12 is further joined with the lower wall 11 near the open end 14 so as to increase the joint strength relative to the socket body 6. The intermediate wall 12 has a generally H-shaped cut-away groove or slit 18 (FIG. 6) to divide the intermediate wall 12 into a resilient locking arm 19 and a transverse retaining strip 20 confronting one another. The resilient locking arm 19 thus provided is resiliently deformable about its proximal end adjacent to the open end 14 of the socket body 6, the distal end of the locking arm 19 being disposed closer to the rear end wall 13 than the retaining surfaces **17*a* of the retaining projections 17. The locking arm 19 has in its lower surface a transverse groove or recess 21 located adjacent to the proximal end of the locking arm 19 so as to facilitate flexing of the locking arm 19 in a direction toward the lower wall 11. The resilient locking arm 19 further has a locking projection 22 formed integrally with and disposed on an upper surface of the locking arm 19 adjacent to the distal end of the locking arm 19 so as to project upwardly toward the upper wall 10. The locking projection 22 extends throughout the width of the locking arm 19 and has opposite ends normally held in confrontation with the retaining surfaces 17*a*, 17*a* of the respective retaining projections 17, 17. The locking projection 22, as shown in FIG. 5, a canted retaining surface 22*a* at a rear end thereof facing toward the rear end wall 13 of the socket body 6 for interlocking engagement with a locking lug later described, on the main plug 2, and a sloped guide surface 22*b* at the front end thereof facing toward the open end 14 of the socket body 6 for assisting smooth insertion of the main plug 2 into the guide chamber 15. The retaining strip 20 has the same width as the locking arm 19 and serves to support thereon the locking lug on the main plug 2 in a manner described hereinafter when the locking lug is locked with the resilient locking arm 19**.

The intermediate wall 12 is disposed closer to the lower wall 11 than to the upper wall 10. The lower wall 11 is engageable with a lower surface of the distal end of the resilient locking arm 19 to limit movement of the locking arm 19 when the locking arm 19 is flexed toward the lower wall 11, thus preventing the resilient locking arm 19 from being damaged or broken during uncoupling operation of the buckle assembly.

The belt retaining portion 7 includes a pair of parallel spaced slide plates 24, 24 integral with and extending from the respective rear ends of the side walls 9, 9 of the socket body 6, a transverse connecting bar 26 interconnecting the slide plate 24 remote from the socket body 6, and a transverse crossbar 25 extending parallel to and disposed between the connecting bar 26 and the rear end wall 13. The belt retaining portion 7 has two transverse slots 27, 27 defined between the rear end wall 13 and the crossbar 25 and between the crossbar 25 and the connecting bar 26 for the passage therethrough of an end of a first strap or belt B1 indicated by phantom lines in FIG. 2. The end of the first belt B1 is connected to the belt retaining portion 7 with its portion looped around the crossbar 25 so that the effective length of the first belt B1 can be adjusted. The crossbar 25 has a toothed first locking edge **25*a* (FIG. 5) facing toward the rear end wall 13 and a toothed second locking edge 25*b* (FIG. 5) facing upwardly for firm engagement with the first belt B1 to prevent the first belt B1 from being loosened when it is tensioned. Likewise, the connecting bar 26 has a downwardly directed toothed locking edge 26*a***.

Figure 3:
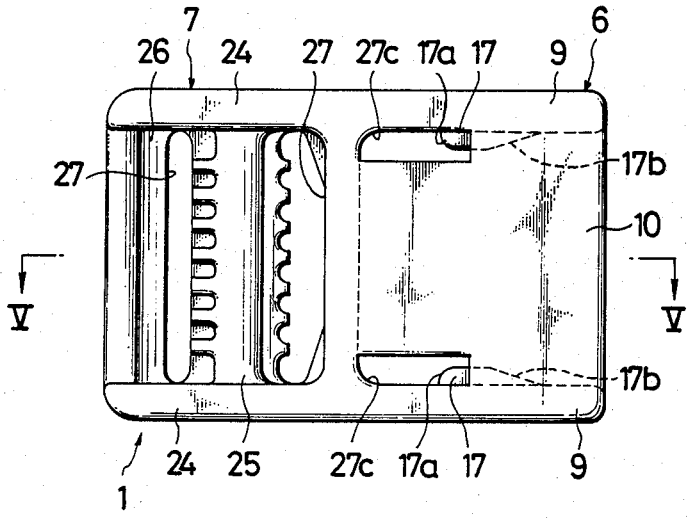
FIG. 3 is a plan view of a socket of the buckle assembly.
Figure 4:
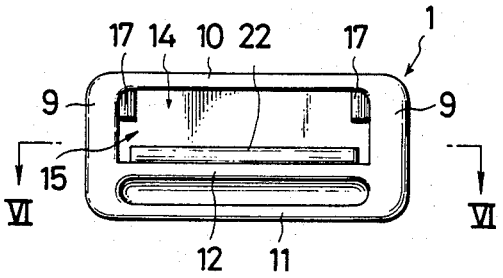
FIG. 4 is a right side view of FIG. 3.
Figure 6:
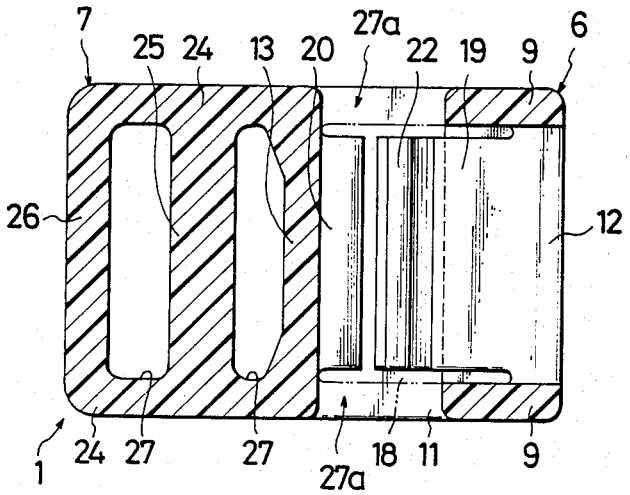
FIG. 6 is a cross-sectional view taken along line VI—VI of FIG. 4.

As shown in FIGS. 5 and 6, the side walls 9, 9 are recessed as at **27*a*, 27*a*. The recesses 27*a* have been formed by a pair of opposed lateral sliding cores of a mold assembly (neither shown) used for the formation of the distal end of the locking arm 19, the H-shaped slit 18 and the retaining strip 20. Likewise, an opening 27*b* defined in the lower wall 11 adjacent to the open end 14 has been formed by a vertical sliding core, not shown, used for the formation of the proximal end portion of the resilient locking arm 19. The upper wall 9 has a pair of apertures 27*c*, 27*c* adjacent to the respective side walls 9, 9, as shown in FIG. 3, which apertures 27*c*, 27*c* have been formed by non-illustrated vertical sliding cores employed for the formation of the respective retaining projections 17, 17 when the socket 1** has been molded.

Figure 7:
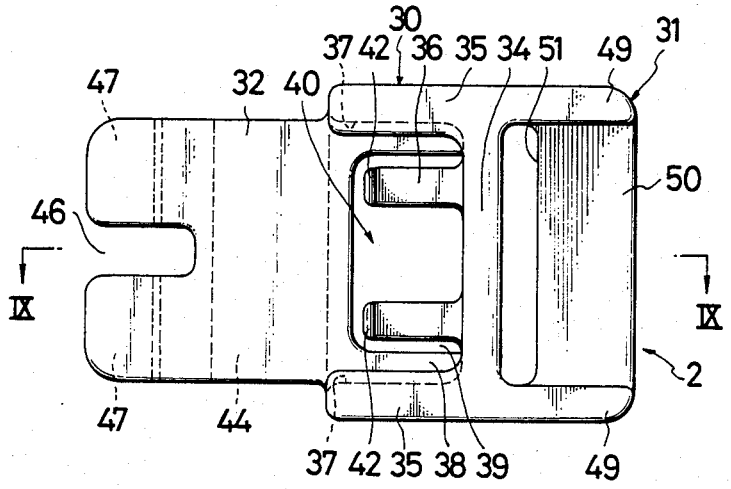
FIG. 7 is a plan view of a main plug of the buckle assembly.
Figure 8:
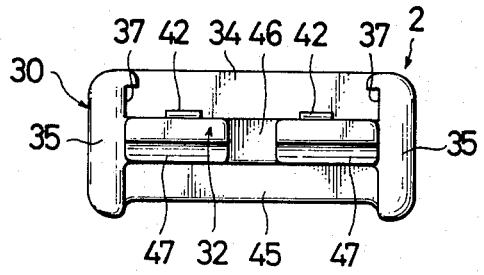
FIG. 8 is a left side view of FIG. 7.
Figure 9:
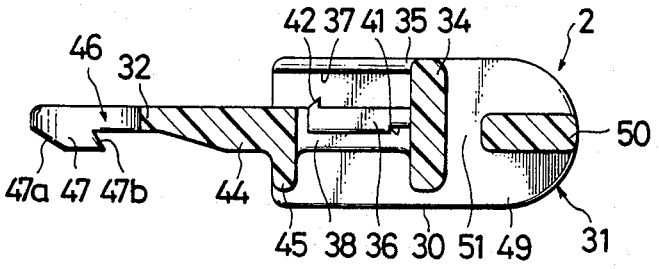
FIG. 9 is a cross-sectional view taken along line IX—IX of FIG. 7.

The main plug 2, as shown in FIGS. 7 through 9, includes a generally rectangular thick base portion 30 for supporting thereon the auxiliary plug 3 (FIG. 1), a belt retaining portion 31 extending from one end of the base portion 30 for connection with a second belt B2 (FIG. 1), and a thin planar resilient locking tongue 32 extending from an opposite end of the base portion 30 in a direction away from the belt retaining portion 31.

The base portion 30 has the same width as the socket body 6 (FIG. 1) and includes a transverse base 34 and a pair of opposed side retainer plates 35, 35 extending perpendicularly from opposite ends of the base 30 and terminated at a proximal end of the locking tongue 32. The base portion 30 further has a pair of parallel spaced resilient flaps 36, 36 cantilevered to the base 34 and disposed between the side retainer plates 35, 35. The side retainer plates 35, 35 have a pair of confronting longitudinal guide grooves 37, 37, respectively, extending in the respective inner surfaces of the side retainer plates 35, 35 for slidably receiving therein a planar head later described, of the auxiliary plug 3. The guide grooves 37 lie in a plane extending immediately above the general plane of the resilient locking tongue 32. The resilient flaps 36 are formed by the provision of a generally E-shaped opening in a transverse connecting plate 38 extending between the side retainer plates 35. The E-shaped opening is composed of a generally horizontally U-shaped slit 39 extending contiguously along one of the side retainer plates 35, the proximal end portion of the locking tongue 32 and the opposite side retainer plate 35, and a substantially rectangular aperture 40 disposed centrally between opposed stems of the U-shaped slit 39 and extending continuously from the base of the U-shaped slit 39 to the transverse base 34. Thus, the resilient flaps 36 extend from the transverse base 34 in the same direction as the resilient tongue 32 and laterally spaced by the rectangular aperture 40 which has a transverse width slightly larger than the width of a third belt B3 (FIG. 1) for receiving a part of the third belt B3. As shown in FIG. 9, the resilient flaps 36, 36 are thinner than the transverse connecting plate 38 and hence resiliently deformable in a vertical direction about their proximal end. To enhance the resiliency of the resilient flaps 36 in a downward direction, there is provided a transverse recess 41 extending in a lower surface of each of the resilient flaps 36 adjacent to the proximal end of the same. The resilient flap 36 includes a transverse stopper ridge 42 projecting from an upper surface thereof at the distal end of the resilient flap 36. The stopper ridge 42 of the resilient flaps 36 are engageable with a portion of the auxiliary plug 3 to limit sliding movement of the latter in a direction away from the base 34.

The resilient locking tongue 32 has substantially the same width as the guide channel 15 in the socket body 6 (FIG. 1) and is joined at its proximal end with the transverse connecting plate 38 of the base portion 30. The locking tongue tapered 32 has a tapered transverse reinforcement 44 on its lower surface adjacent to the locking tongue 32 for strengthening the locking tongue 32 against breakage at the proximal end thereof. The tapered portion bank 44 has a height such that the proximal end portion of the locking tongue 32 has a thickness substantially the same as the thickness of the transverse connecting plate 38. The tapered portion 44 extends throughout the width of the locking tongue 32 and is tapered toward the distal end of the locking tongue 32 for facilitating smooth reception of the locking tongue 32 into the guide chamber 15 when the main plug 2 is coupled with the socket 1. The tapered reinforcement 44 is integral with a transverse positioning rib 45 disposed on a lower surface of the transverse connecting plate 38 and extending between the side retainer plates 35, 35. The positioning rib 45 is engageable with an end edge of the intermediate wall 12 to prevent wobbling or displacement of the socket 1 relative to the main plug 2 in a direction perpendicular to the general plane of the buckle assembly when the socket 1 and the main and auxiliary plugs 2, 3 are coupled together. The distal end portion of the locking tongue 32 is bifurcated by a central longitudinal groove 46 extending from, the distal end of the locking tongue 32 toward the tapered reinforcement 44 and terminating short of the tapered reinforcement 44. The groove 46 is receptive of a releasing cam projection later described, of the auxiliary plug 3. The locking tongue 32 has a locking lug 47 formed integrally with and disposed on the lower surface of the locking tongue 32 at the bifurcated distal end of the locking tongue 32. The locking lug 47 extends transversely throughout the width of the locking tongue 32 but is centrally interrupted by the central longitudinal groove 46. The locking lug 47, as shown in FIG. 9, has a beveled guide surface **47*a* at the front end thereof sloping gently downwardly, and a canted locking surface 47*b* at the rear end thereof facing toward the reinforced proximal end of the locking tongue 32. The gently sloping guide surface 47*a* is slidably engageable with the guide surface 22*b* of the resilient locking arm 19 to flex the locking arm 19 downwardly toward the lower wall 11 when the locking tongue 32 of the main plug 2 is forced into the guide chamber 15 in the socket 1. The canted locking surface 47*b* is interlockingly engageable with the retaining surface 22*a* of the locking arm 19 when the locking tongue 32 is fully received in the guide chamber 15 in the socket 1**.

The belt retaining portion 31 of the main plug 2 includes a pair of opposed side plates 49, 49 extending perpendicularly from the opposite ends of the transverse base 34 in a direction away from the respective side retainer plates 35, 35, and a transverse crossbar 50 interconnecting the distal ends of the side plates 49, 49 and extending parallel to the transverse base 34 with a transverse slot 51 defined therebetween for the passage of the second belt B2 (FIG. 1) when an end of the second belt B2 is connected to the belt retaining portion 31 with its longitudinal portion looped around the transverse crossbar 50.

Figure 10:
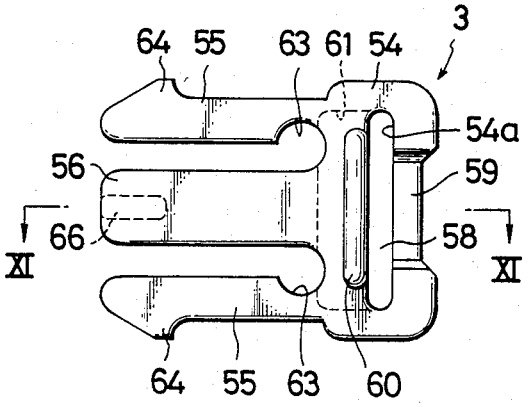
FIG. 10 is a plan view of an auxiliary plug of the buckle assembly.
Figure 11:
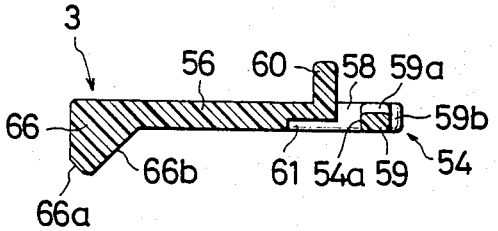
FIG. 11 a cross-sectional view taken along line XI—XI of FIG. 10.

The auxiliary plug 3, as shown in FIGS. 10 and 11, has a generally planar structure and includes a generally rectangular head 54, a pair of parallel spaced resilient locking legs 55, 55 extending from the head 54 in a common direction, and a resilient releasing leg 56 disposed between the locking legs 55 and extending from the head 54 in parallel spaced relation to the locking legs 55. The locking legs 55 and the releasing leg 56 are receivable in the guide chamber 15 in the socket 1.

The rectangular head 54 has a width substantially the same as or slightly smaller than the distance between the opposed longitudinal guide grooves 37 in the base portion 30 of the main plug 2 so that opposite side edges of the head 54 are slidably receivable in the guide grooves 37 in the head portion 30 to assemble the auxiliary plug 3 with the main plug 2. The head 54 has a central transverse slot 58 for the passage therethrough the third belt B3 (FIG. 1). The slot 58 is longer than the minimum distance between the resilient flaps 36 of the main plug 2 and has a width greater than the width of the stopper ridge 42 so that the stopper ridge 42 on the resilient flaps 36 are receivable in the transverse slot 58 and interlockingly engageable with an abutment surface **54*a* of the head 54 to prevent movement of the head 54 in a direction to detatch the auxiliary plug 3 from the main plug 2. The abutment surface 54*a* defines one side of the transverse slot 58 which is remote from the locking legs 55. With the transverse slot 58 formed in the head 54, the auxiliary plug 3 has a belt retaining portion 59 disposed at the one side of the slot 58 and extending along a central portion of the rear edge of the head 54** over a distance substantially the same as the width of the third belt B3. The belt retaining portion 59 is recessed at its upper and rear surfaces 59*a*, 59*b* as shown in FIG. 11 for stably retaining the third belt B3 on the recessed belt retaining portion 59 against lateral displacement. The auxiliary plug 3 further includes a transverse grip protuberance 60 disposed on an upper surface of the head 54 and extending along an opposite side of the transverse slot 58 remote from the belt retaining portion 59 for manipulating the auxiliary plug 3 when coupling and uncoupling the buckle assembly. The head 54 has a guide recess 61 formed in its lower surface and extending from the transverse slot 58 toward the respective proximal end portions of the resilient legs 55, 56 for receiving the stopper ridges 42. The recessed lower surface is engageable with the stopper ridges 42 to limit sliding movement of the auxiliary plug 3 in a direction to couple the auxiliary plug with the main plug 2.

The resilient locking legs 55 extend perpendicularly from the front side edge of the rectangular head 54 and hence overlie the resilient locking tongue 32 of the main plug 2 when the auxiliary plug 3 is assembled with the main plug 2. The resilient locking legs 55 have a pair of confronting arcuate recesses 63, 63 adjacent to their proximal ends so that the resilient locking legs 55 are resiliently deformable inwardly toward each other. Each of the resilient locking legs 55 terminates in an enlarged locking foot 64 projecting laterally outwardly for locking engagement with a corresponding one of the respective retaining surfaces 17*a* of the retaining projections 17 on the socket 1 when the locking legs 55 are snapped with the locking projections 17.

The releasing leg 56 has the same length of the locking legs 55 and includes a releasing cam projection 66 disposed on a lower surface of the releasing leg 56 at a distal end of the releasing leg 56 for engagement with the resilient locking arm 19 of the socket 1 to release the latter from interlocking engagement with the resilient locking tongue 32 of the main plug 2. The releasing cam projection 66 is disposed centrally between the width of the releasing leg 56 so that it is movably received in the central longitudinal groove 46 in the locking tongue 32 when the auxiliary plug 3 and the main plug 2 are assembled together. The releasing cam projection 66 has a beveled front cam surface 66*a* facing obliquely forwardly downwardly of the releasing leg 56, and a beveled rear cam surface 66*b* facing obliquely downwardly rearwardly of the releasing leg 56 and extending substantially perpendicular to the beveled front cam surface 66*a*. The releasing cam projection 66 has a height substantially the same as the maximum thickness of the distal end of the locking tongue 32 including the locking lug 47. The beveled front cam surface 66*a* is engageable with the sloped guide surface (FIG. 5) of the locking arm 19 to resiliently flex the locking arm 19 downwardly toward the lower wall 11 of the socket when the releasing leg 56 is forced into the guide chamber 15 in the socket 1. The beveled rear cam surface 66*b* is engageable with an upper edge of the canted retaining surface 22*a* (FIG. 5) of the locking arm 19 to resiliently flex the locking arm 19 downwardly toward the lower wall when the auxiliary plug 3 is moved relatively to the main plug 2 in a direction to remove the auxiliary plug 3 from the socket 1.

The auxiliary plug 3 is assembled with the main plug 2 by inserting the head 54 of the auxiliary plug 3 into the guide grooves 37 in the main plug 2 with the belt retaining portion 59 directed forwardly until the stopper ridges 44 on the resilient flaps 36 are snapped into the transverse slot 58 in the head 54. In this assembled condition, the head 54 lies flatwise against an upper surface of the transverse connecting plate 38 of the main plug 2 with its opposite end edges slidably received in the respective guide grooves 37 in the side retainer plates 35. The resilient legs 55, 56 of the auxiliary plug 3 lie flatwise against an upper surface of the resilient locking tongue 32 with the releasing cam projection 66 on the releasing leg 56 loosely received in the central longitudinal groove 46 in the locking tongue 32. The auxiliary plug 3 is slidably movable relative to the main plug 2 between an advanced position in which the respective distal edges of the resilient legs 55, 56 extend flush with the distal end edge of the locking tongue 32, as shown in FIG. 2, and a retracted position in which the distal end edges of the resilient legs 55, 56 are retracted from the distal end edge of the locking tongue 32 toward the transverse base 34 of the main plug 2. The advancing or forward movement of the auxiliary plug 3 is limited when the stopper ridges 42 on the resilient flaps 36 engage the abutment surface of the head 54. On the other hand, the retracting or rearward movement of the auxiliary plug 3 is limited upon engagement of the stopper ridges 42 with the end extremity of the guide recess 61 in the head 54.

To assemble the socket 1 and the pre-assembled main and auxiliary plugs 2, 3 of the buckle assembly as shown in FIGS. 1 and 2, the resilient locking tongue 32 of the main plug 2 and the resilient legs 55, 56 of the auxiliary plug 3 are inserted into the guide chamber 15 in the socket 1 while keeping the auxiliary plug 3 in its advanced position. This insertion causes the resilient locking arm 19 to be flexed downwardly toward the lower wall 11 as the locking lug 47 (FIG. 7) of the locking tongue 32 and the releasing cam projection 66 of the releasing leg 56 slide frictionally along the locking projection 22 on the resilient locking arm 19. At the same time, the resilient locking legs 55 are caused to be flexed inwardly toward each other as the locking feet 64 (FIG. 10) slide along the respective sloped guide surfaces 17*b* (FIG. 3) of the retaining projection 17. Slightly after the passage of the releasing cam projection 66 through the locking projection 22, the locking lug 47 is moved past the locking projection 22 whereupon the resilient locking arm 19 flips resiliently back to its original flat position and is so retained by interlocking engagement between the retaining surface 22*a* (FIG. 5) of the locking projection 22 and the locking surface 47*b* (FIG. 9) of the locking lug 47. The main plug 2 is thus locked in place against accidental release from the socket 1. Substantially at the same time, the locking feet 64 of the locking legs 55 are snap-fitted with the respective retaining surfaces 17*a* (FIG. 3) of the retaining projections 17 so that the auxiliary plug 3 is also locked in place against accidental removal from the socket 1. In this coupled condition, the releasing cam projection 66 and the locking lug 47 are held on the retaining strip 20 of the socket 1, as shown in FIG. 2. The releasing cam projection 66 is forwardly spaced a distance from the locking projection of the resilient locking arm 19.

When uncoupling the buckle assembly, this is done by pulling the third belt B3 to thereby move the auxiliary plug 3 rearwardly to its retracted position. This rearward movement of the auxiliary plug 3 causes the resilient locking legs 55 to be flexed inwardly, thereby releasing the locking feet 64 from the respective retaining surfaces 17*a* of the retaining projections 17. Slightly thereafter, the releasing cam projection 66 is brought into abutment with the locking projection 22 on the resilient locking arm 19 and then forces the resilient locking arm 19 to flex downwardly toward the lower wall 11 of the socket 1. With this downward flexing of the resilient locking arm 19, the locking projection 22 on the thus flexed locking arm 19 is brought out of interlocking engagement with the locking lug 47 of the locking tongue 32, thus disengaging the locking tongue 32 from the locking arm 22. Upon this disengagement, the resilient locking arm 19 flips resiliently back to its original flat position in which instance the main plug 2 is thrusted rearwardly by the locking projection 22 on the locking arm 19. The auxiliary plug 3 is moved rearwardly with the rearward movement of the main plug 2. The rearward movement of the auxiliary plug 3 is promoted as the locking feet 64 of the resilient locking legs 55 slide down along the respective sloped guide surfaces **17*b* of the retaining projections 17 of the socket 1. Then the main plug 2 and the auxiliary plug 3 held on the main plug 2 are removed from the socket 1** by pulling the second belt B2.

As described above, the locking projection 22 on the resilient locking arm 19 is hooked with the locking lug 47 of the resilient locking tongue 32 to thereby retain the main plug 2 and the socket 1 in firmly coupled condition against accidental separation. Furthermore, the auxiliary plug 3 is slidably mounted on the main plug 2 so that coupling of the buckle assembly can be achieved automatically by connecting the main plug 2 and the socket 1. Yet, uncoupling of the buckle assembly can be achieved only by displacing the auxiliary plug 3 in one direction relative to the main plug 2. The buckle assembly of the foregoing construction, therefore, can be assembled and disassembled quickly with utmost ease.

Obviously, various modifications and variations of the present invention are possible in the light of the above teaching. It is therefore to be understood that within the scope of the appended claims the invention may be practiced otherwise than as specifically described.

What is claimed is:

1. A buckle assembly for releasably connecting three belts, comprising:

(a) a socket for being attached to a first belt and including a hollow socket body having a pair of opposed side walls, an upper wall interconnecting respective upper edges of said side walls, and an intermediate wall extending between said side walls in parallel spaced relation to said upper wall so as to define, jointly with said side walls, and said upper wall, a guide chamber, said socket body further having a pair of retainer projections projecting from said side walls, respectively, into said guide chamber, said intermediate wall having a connected cantilevered resilient locking arm;

(b) a main plug for being attached to a second belt and including a base portion and a resilient locking tongue extending from an end of said base portion and receivable in said guide chamber in said socket body, said resilient locking tongue being interlockingly engageable with said resilient locking arm to couple said main plug and said socket; and (c) an auxiliary plug for being attached to a third belt and slidably mounted on said main plug, said auxiliary plug including a head slidably retained on said base portion of said main plug, a pair of parallel spaced resilient locking legs extending from an end of said head and receivable in said guide chamber of said socket body, and a resilient releasing leg disposed between said resilient locking legs and extending from said end of said head in the same direction as said resilient locking legs, said resilient locking legs being snappingly engageable with said retaining projections, respectively, to couple said auxiliary plug and said socket, said resilient releasing leg having a releasing cam projection engageable with said resilient locking arm to flex the resilient locking arm against its resiliency in a direction to disengage said resilient locking arm from said resilient locking tongue.

2. A buckle assembly according to claim 1, each said retaining projection having a rounded retaining surface facing in a direction away from an open end of said hollow socket body, each said resilient locking leg having an enlarged locking foot interlockingly engageable with said rounded retaining surface.

3. A buckle assembly according to claim 2, each said retaining projection further having a sloped guide surface extending contiguously from said rounded retaining surface toward said open end of said hollow socket body and slidably engageable with said locking foot of each said locking leg.

4. A buckle assembly according to claim 1, said intermediate wall further having a retainer strip disposed in confrontation to a distal end of said cantilevered resilient locking arm for holding thereon a distal end of said resilient locking tongue and said releasing cam projection on said releasing leg when said socket is coupled with said main and auxiliary plugs.

5. A buckle assembly according to claim 1, said resilient locking arm having a locking projection disposed at a distal end of said locking arm and projecting into said guide chamber in said socket, said locking tongue having a locking lug at a distal end thereof, said locking lug being interlockingly engageable with said locking projection.

6. A buckle assembly according to claim 5, said locking projection on said locking arm having a sloped guide surface facing toward an open end of said hollow socket body, said locking lug having a beveled front guide surface slidably engageable with said sloped guide surface of said locking projection.

7. A buckle assembly according to claim 1, said cantilevered resilient locking arm having a transverse groove adjacent, the connection of said cantilevered resilient locking arm with said intermediate wall said transverse groove extending in a lower surface of said locking arm which faces away from said guide chamber in said socket body.

8. A buckle assembly according to claim 1, said auxiliary plug having a substantially planar structure and disposed flatwise against an upper side of said main plug, said locking tongue having a guide groove extending longitudinally from a distal end thereof toward said base portion and loosely receptive of said releasing cam projection, said releasing cam projection having a height substantially equal to the maximum thickness of said distal end of said locking tongue.

9. A buckle assembly according to claim 1, said base portion having a pair of opposed side retainer plates extending parallel to said locking tongue and having a pair of confronting longitudinal guide grooves, respectively, for slidably receiving therein opposite side edges of said head of said auxiliary plug.

10. A buckle assembly according to claim 9, said base portion further including at least one resilient flap disposed between, and extending parallel to, said side retainer plates, said at least one resilient flap having a transverse stopper ridge projecting upwardly from a distal end of each of said at least one resilient flap, said head of said auxiliary plug having a transverse slot and an abutment surface defining one side of said transverse slot, said transverse slot being receptive of said stopper ridge, said stopper ridge being engageable with said abutment surface to limit movement of said auxiliary plug relative to said main plug in a first direction to detach said auxiliary plug from said main plug.

11. A buckle assembly according to claim 10, said head further having a guide recess extending contiguously from an opposite side of said transverse slot in a direction away from said abutment surface, said stopper ridge being engageable with an end extremity of said guide recess remote from said abutment surface to limit movement of said auxiliary plug relative to said main plug in a second direction opposite to said first direction.

12. A buckle assembly according to claim 10, said head further having a recessed belt retaining portion extending along said one side of said transverse slot for connection to the third belt, said base portion having a recess for receiving therein a part of the third belt.

13. A buckle assembly according to claim 1, said auxiliary plug including a transverse grip protuberance disposed on an upper surface of said head.

14. A buckle assembly according to claim 1, said resilient locking arm having a locking projection disposed at a distal end of said locking arm and projecting into said guide chamber in said socket, said locking projection having a canted front retaining surface and a sloped rear guide surface, said releasing cam projection having a beveled front cam surface frictionally engageable with said sloped rear guide surface to flex the resilient locking arm in a direction outwardly away from said guide chamber, and a beveled rear cam surface frictionally engageable with said canted front retaining surface to flex the resilient locking arm outwardly away from said guide chamber.

15. A buckle assembly according to claim 1, said socket, said main plug and said auxiliary plug being molded of synthetic resin.

* * * * *